US005576670A

United States Patent [19]

Suzuki et al.

[11] Patent Number: 5,576,670

[45] Date of Patent: Nov. 19, 1996

[54] BRANCHING FILTER FOR TRANSMITTER-RECEIVER

[75] Inventors: Takuya Suzuki; Yoshio Minowa, both of Tokyo, Japan

[73] Assignee: NEC Corporation, Japan

[21] Appl. No.: 363,414

[22] Filed: Dec. 23, 1994

[30] Foreign Application Priority Data

Dec. 28, 1993 [JP] Japan ..... 5-334262

[51] Int. Cl.[6] ..... H01P 5/16

[52] U.S. Cl. ..... 333/126; 333/21 A; 333/208

[58] Field of Search ..... 333/21 R, 21 A, 333/126, 135, 208, 210; 29/600

[56] References Cited

U.S. PATENT DOCUMENTS

| | | | |
|---|---|---|---|
| 2,747,184 | 5/1956 | Kock | 333/208 X |
| 4,653,568 | 3/1987 | Baldelli | 164/155.5 X |
| 4,783,639 | 11/1988 | Hudspeth et al. | 333/126 |
| 4,908,523 | 3/1990 | Snowden et al. | 307/43 |
| 5,243,306 | 9/1993 | Minowa et al. | 333/135 |
| 5,276,456 | 1/1994 | Kim | 333/126 X |
| 5,291,650 | 3/1994 | Carvelho et al. | 29/600 |

FOREIGN PATENT DOCUMENTS

| | | |
|---|---|---|
| 0401995 | 5/1990 | European Pat. Off. . |
| 0502499 | 4/1992 | European Pat. Off. . |
| 4-276903 | 10/1992 | Japan . |
| 928938 | 6/1961 | United Kingdom . |

OTHER PUBLICATIONS

Patent Abstract Of Japan vol. 006, No. 088 (P-118), 26 May 1982 & JP-A-57 025022 (Toshiba Corp.), 9 Feb. 1982.

*Primary Examiner*—Paul Gensler

*Attorney, Agent, or Firm*—Ostrolenk, Faber, Gerb & Soffen, LLP

[57] ABSTRACT

A branching filter for a transmitter-receiver which is used in a microwave band comprising an orthogonal-mode transducer (waveguide branching filter), a reception filter comprising a band-eliminating filter 4 which is connected to the extension of the center axis of the waveguide of the orthogonal-mode transducer, and a transmission filter comprising a high pass filter containing a cut off waveguide which is directly and orthogonally connected to the orthogonal-mode transducer. The parts of the branching filter for the transmitter-receiver are integrally manufactured as one body by a lost wax process. Therefore, the branching filter for the transmitter-receiver can be manufactured as a compact-size single body having no patch or linking portion.

13 Claims, 4 Drawing Sheets

BRANCHING FILTER FOR TRANSMITTER-RECEIVER

BACKGROUND OF THE INVENTION

1. Field of the Invention

This invention relates to a branching filter (distributor) for a transmitter-receiver, which has a transmitter port for receiving an input transmit signal, a receiver port, and an antenna port for receiving an input receive signal and is for distributing the input transmit signal to the antenna port and the input receive signal to the receiver port.

2. Description of Related Art

A branching filter for a transmitter-receiver is known as being used to commonly use an antenna for transmission and reception for using a microwave band. A conventional branching filter for a transmitter-receiver comprises a transmission filter, a waveguide branching filter coupled to the transmission filter, a bend waveguide coupled to the waveguide branching filter, and a reception filter coupled to the bend waveguide. In the conventional branching filter for the transmitter-receiver, it is impossible to easily and cheaply produce the branching filter, and it must be designed in larger size because the transmission filter, the reception filter, the waveguide branching filter and the bend waveguide filter are separately fabricated.

On the other hand, a transmitter-receiver comprises a transmitter module, a branching filter module coupled to the transmitter module, and a receiver module coupled to the branching filter module.

In a conventional transmitter-receiver, a transmitter module comprises a transmitter connector, and a receiver module comprises a receiver connector. On putting the transmitter-receiver in operation, a cable is connected to the transmitter connector and the receiver connector. Points of connection of the cable to the transmitter connector and the receiver connector are covered for hermetic seal and for insuring waterproofness by a first and a second connector cover. It is hardly possible in the conventional transmitter-receiver to exchange the first and the second connector covers to new covers.

FIG. 4 is an exploded perspective view showing a conventional separate type branching filter for a transmitter-receiver as disclosed in U.S. Pat. No. 5,243,306. This branching filter for the transmitter-receiver was proposed to overcome the "large-size structure problem" of the branching filter for the transmitter-receiver as described above.

As shown in FIG. 4, the conventional branching filter for transmitter-receiver basically comprises three parts, that is, a first part 101, a second part 102 which is detachably coupled to the first part 101 and a third part 103 which is detachably coupled to the second part 102. The first part 101 includes an antenna port, a part of a waveguide branching filter (orthogonal transducer) and a part of a reception filter. The second part 102 includes the residual (other) part of the waveguide branching filter, the residual (other) part of the reception filter and a part of a transmission filter. The third part 103 includes the residual (other) part of the transmission filter. The reception filter which is assembled by the first and second parts 101 and 102 is provided with a bend waveguide 104 to facilitate a connection work between the branching filter and a transmitter-receiver.

FIG. 5 is a cross-sectional view showing an assembly of the first, second and third parts 101, 102 and 103. The assembly is designed in a dimension of about 160 mm (height)×80 mm (width), for example. FIG. 6 is a cross-sectional view showing partially the third part 103 shown in FIG. 4. The third part 103 is designed in a dimension of about 70 mm (width)×65 mm (height), for example.

In the conventional branching filter for transmitter-receiver as described above, each of the waveguide branching filter, the transmission filter and the reception filter is divided into plural parts, and these plural parts are fabricated into a waveguide. Therefore, if each part is manufactured with a dimensional error or fabricated with a positional error, a step portion would occur at a divisional (partitional) face portion of the finally-fabricated waveguide (i.e., at the boundary between the parts constituting the waveguide) because of the dimensional or positional error).

If a step portion occurs at the divisional face portion of the waveguide of the waveguide branching filter, cross-polarized discriminating power (XPD) is deteriorated. Further, if a step portion occurs at the divisional face portion of the waveguide of each of the transmission filter and the reception filter, intrinsic impedance of each filter is deteriorated. In this case, the impedance of each filter is deviated from a predetermined impedance to induce reflected wave or standing wave, resulting in occurrence of transmission loss.

Further, since the branching filter for transmitter-receiver is constructed by assembling plural parts, fixing members for fixing the respective parts are required, and thus the branching filter for a transmitter-receiver must be designed in large size.

Still further, as described above, the bend waveguide is provided to the reception filter side. Therefore, in a case where the bend waveguide is disposed between the reception filter and the reception connection port, the branching filter for the transmitter-receiver must be designed in large size. On the other hand, in a case where the bend waveguide is disposed between the reception filter and the waveguide branching filter, the total length of the branching filter and a transmitter-receiver when the transmitter-receiver is connected to the branching filter is excessively large.

SUMMARY OF THE INVENTION

An object of the present invention is to provide a branching filter (distributor) for a transmitter-receiver which can be miniaturized without increasing the total length when the branching filter and the transmitter-receiver are connected to each other, and which requires no fabrication or assembling process.

In order to attain the above object, the branching filter for a transmitter-receiver according to the present invention includes an orthogonal-mode transducer (waveguide branching filter) having an antenna port at one side thereof, a reception filter which is connected at one side thereof to an extension of the central axis of the waveguide of the orthogonal-mode transducer through an impedance converter and has a receiver port at the other side, and a transmission filter having a cut off waveguide whose impedance is matched by an L-rod (inductive susceptance) and which is orthogonally and directly connected to the orthogonal-mode transducer at one side thereof and has a transmitter at the other side thereof, wherein the orthogonal-mode transducer, the reception filter and the transmission filter being integrally constructed by one part.

Further, the transmission filter may be spirally formed around the central axis of the waveguide of the orthogonal-mode transducer to miniaturize the whole construction of the branching filter for transmitter-receiver. In addition, the surrounding body of the waveguide may be formed to be uniform thickness and miniaturized, so that the branching filter for the transmitter-receiver can be manufactured as an integral body of one part using a lost wax casting method which is suitable for mass production.

DETAILED DESCRIPTION OF THE PREFERRED EMBODIMENT

A preferred embodiment according to the present invention will be described hereunder with reference to the accompanying drawings.

Figure 1:
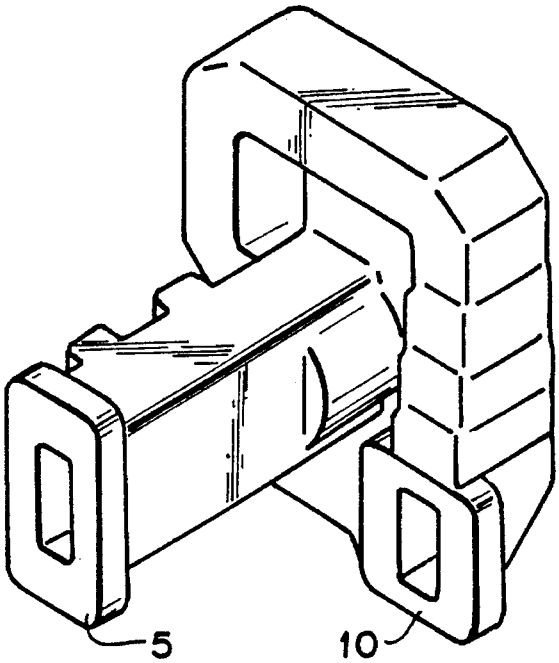
FIG. 1 is a perspective view showing a branching filter for a transmitter-receiver of an embodiment according to the present invention.
Figure 2:
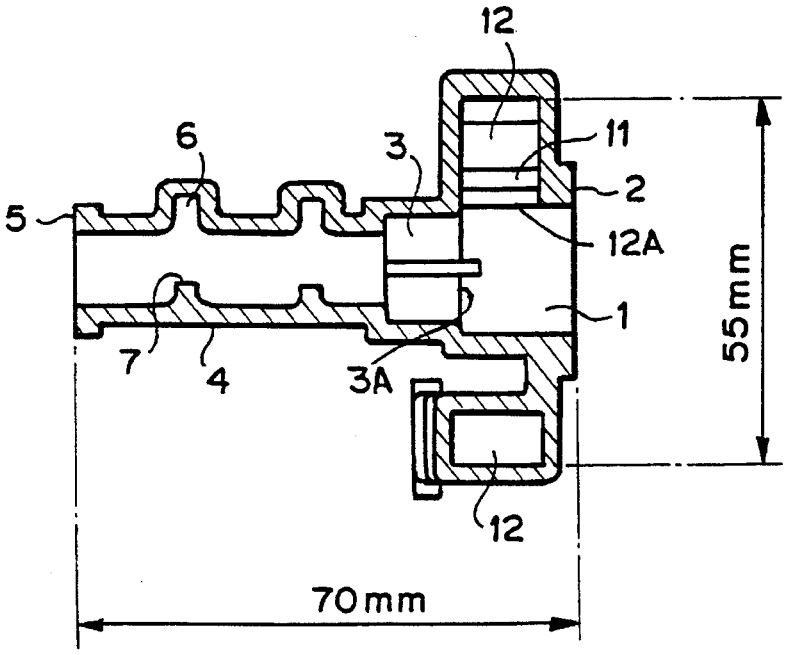
FIG. 2 is a cross-sectional view showing the branching filter for the transmitter-receiver of the embodiment of FIG. 1.
Figure 3:
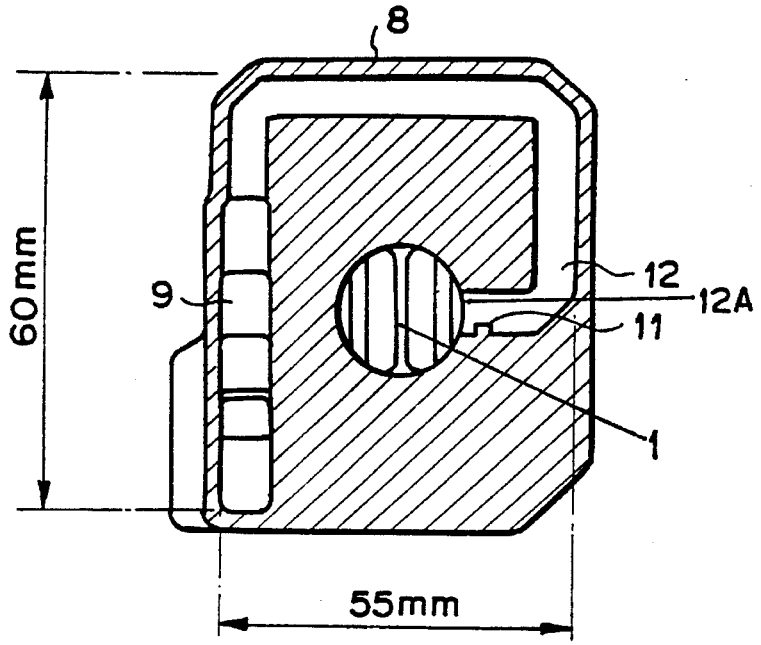
FIG. 3 is a cross-sectional view of spiral waveguide passageways portion showing the branching filter for the transmitter-receiver of the embodiment of FIG. 1.
Figure 4:
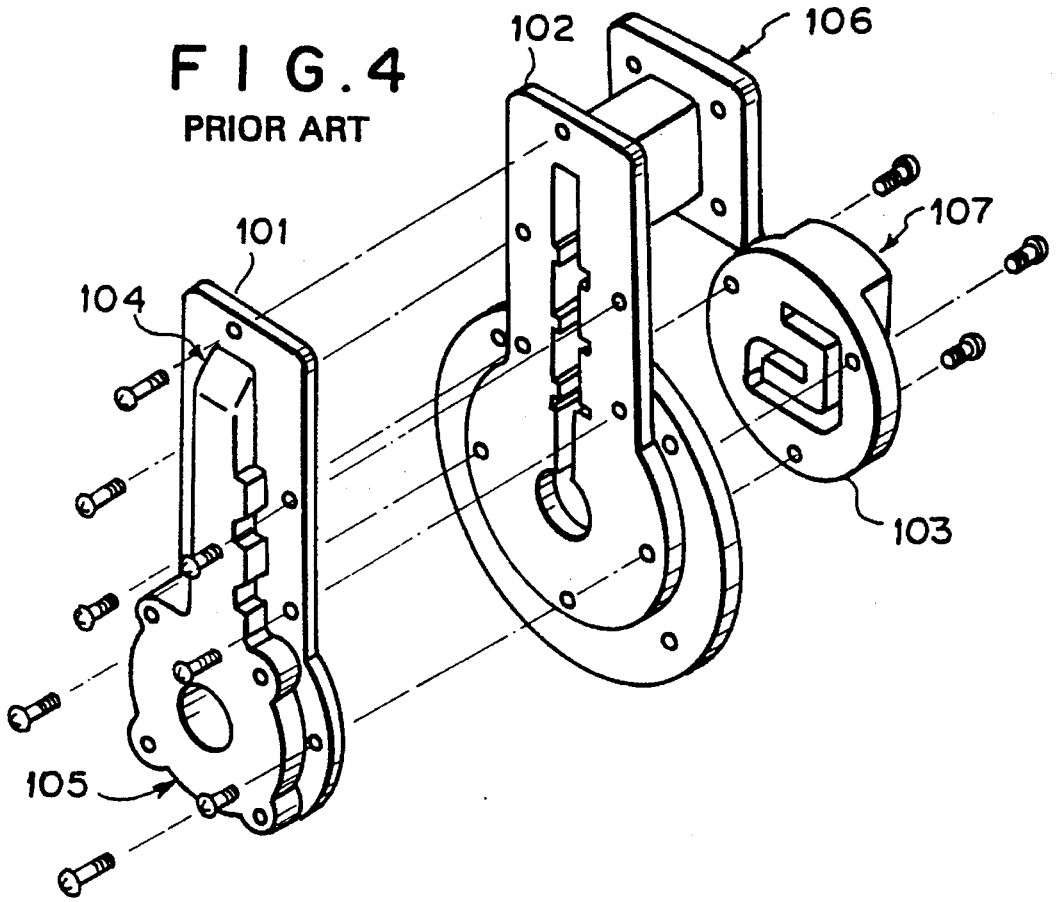
FIG.4 PRIOR ART
FIG. 4 is an exploded view showing a conventional branching filter for a transmitter-receiver.
Figure 5:
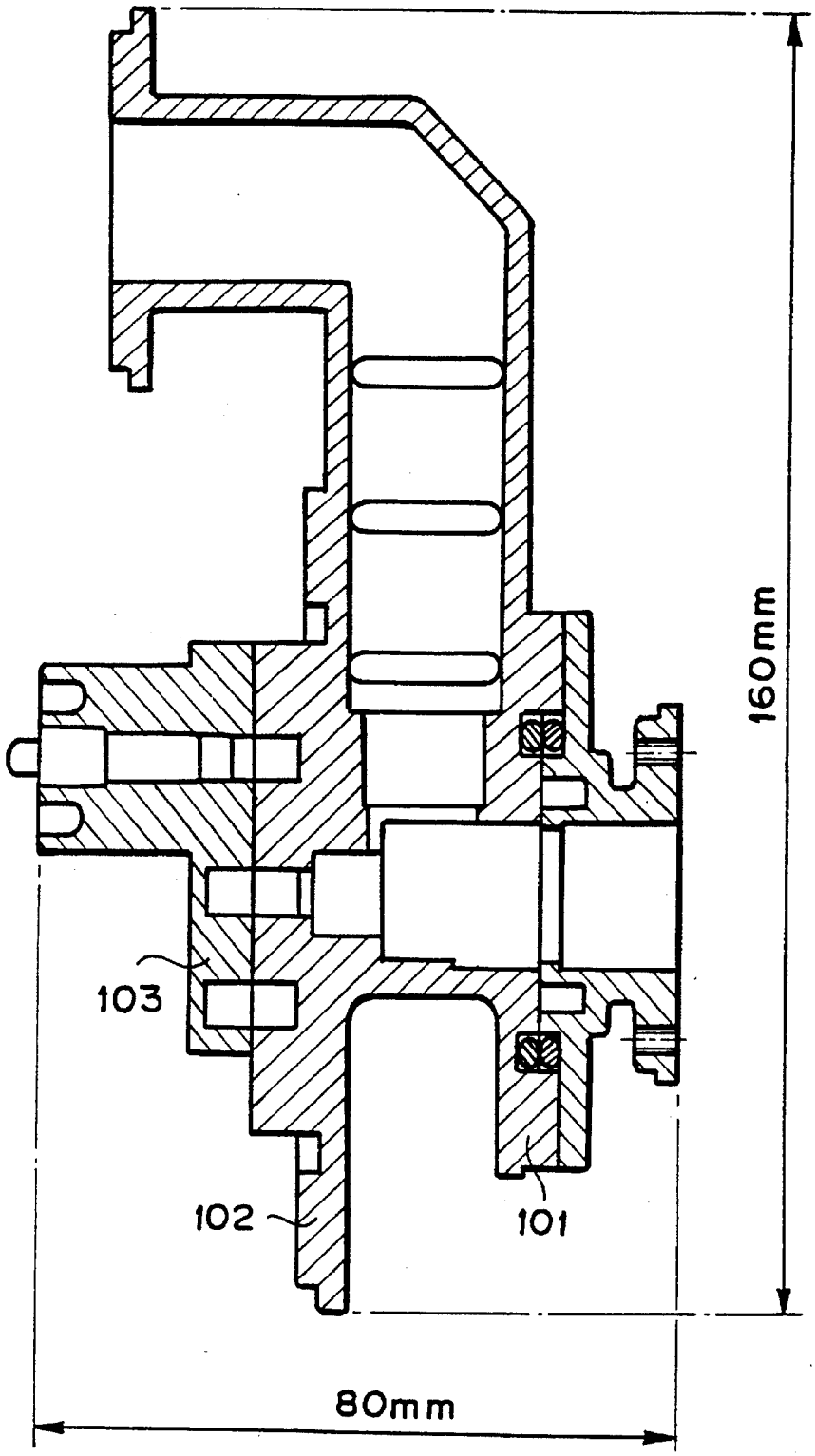
FIG.5 PRIOR ART
FIG. 5 is a cross-sectional view showing the conventional branching filter for the transmitter-receiver with actual dimension.
Figure 6:
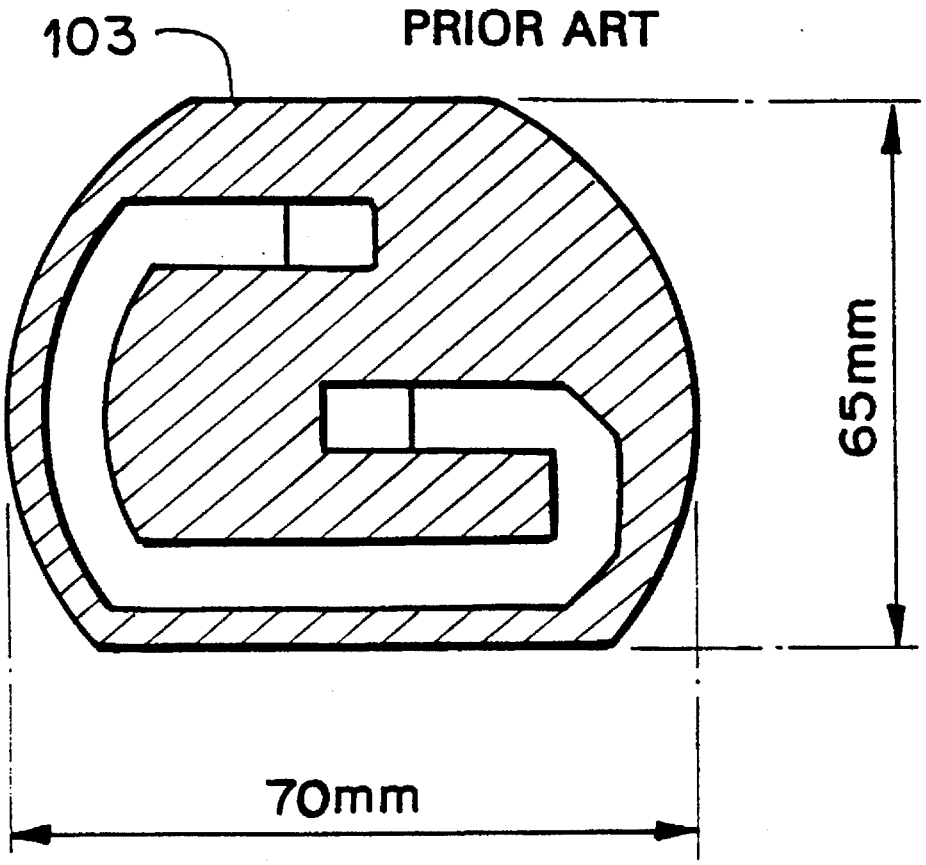
FIG.6 PRIOR ART
FIG. 6 is a cross-sectional view showing the third part with actual dimension.

FIG. 1 is a perspective view showing a branching filter for a transmitter-receiver according to an embodiment of the present invention, FIG. 2 is a cross-sectional view of the branching filter for the transmitter-receiver, which is taken along the center axis of a reception filter, and FIG. 3 is a cross-sectional view of the branching filter for the transmitter-receiver, which is taken along the center axis of a transmission filter.

As shown in FIGS. 2 and 3, the branching filter for the transmitter-receiver of this embodiment is functionally divided into three parts, an orthogonal-mode transducer 1 serving as a waveguide branching filter, a band-elimination filter 4 serving as a reception filter, and a high pass filter 8 serving as a transmission filter, however, these parts are manufactured as one body while structurally having thin and unified thickness. The orthogonal-mode transducer 1 has an antenna port 2 at one end thereof (corresponding to one end of the extension of the center axis of the waveguide of the orthogonal-mode transducer 1) while it has an impedance transformer section 3 having a septum 15 and connected through a first short impedance transducer section 3A for impedance-matching between the orthogonal-mode transducer 1 and the band-elimination filter 4 and having no multiple-step impedance transducer section at the other side thereof and is connected to the band-eliminating filter 4 through the impedance transformer section 3 at the reception side. The band-eliminating filter 4 has a receiver port 5 at one side thereof which is opposite to the orthogonal-mode transducer side. The band-eliminating filter 4 includes plural cavities 6 and plural bosses 7, and the cavities 6 are disposed at intervals of quarter wavelength or three-quarter wavelength. A second short impedance transducer section 12A is orthogonally connected to the orthogonal-mode transducer 1. At the back section of the second short impedance transducer section 12A, the high pass filter 8 serving as the transmission filter has an impedance transformer section 9 and a transmitter port 10, and is orthogonally connected to the orthogonal-mode transducer 1. That is, the orthogonal-mode transducer 1 is connected through the impedance transformer section 3 and the band-eliminating filter (reception filter) 4 to the receiver port 5, and also connected through the high pass filter (transmission filter) 8 and the impedance transformer section 9 to the transmitter port 10.

The high pass filter 8 is constructed by a cut off waveguide which is provided with an L-rod (inductive susceptance) 11 to match its impedance with that of the orthogonal-mode transducer 1 and is designed so that the H-plane (magnetic field plane) of the waveguide is slightly made thin, that is, so that the waveguide path is further thinned. Particularly, the portion of the high pass filter 8 at the transmitter port side is constructed by a step conversion waveguide (impedance conversion waveguide). Further, the dimension (length and width) of the cut off waveguide 12 is determined to obtain such an attenuation amount that signals on a reception frequency band are not passed. The transmission filter 8 is disposed in a spiral form around the center axis of the waveguide of the orthogonal-mode transducer 1.

This invention is not limited to the above embodiment, and various modifications may be made without departing from the subject matter of this invention. For example, the orthogonal-mode transducer 1 may be designed to have a circular or rectangular shape in section. The orthogonal-mode transducer 1 may be provided at one end thereof with a circular or rectangular coupling hole through which the reception wave is taken out, and also provided at the wall thereof with a rectangular coupling hole through which the transmission wave is fed out.

Further, the reception filter 4 may be constructed by a band rejection filter (the band eliminating filter) in which rectangular cavities 6 for eliminating transmission frequency band signals are provided on the H-plane of the rectangular waveguide (magnetic field plane) and circular or rectangular bosses 7 for pass band matching may be provided on the opposite (confronting) sides of the rectangular cavities 6.

In addition, the transmission filter 8 may have the cut off waveguide 12 in which the H-plane of the rectangular waveguide to pass the transmission high frequency wave is made thin toward the E-plane, and further the transmission filter 8 may be provided with the stepwise impedance transformer waveguide 9 for impedance matching at the transmitter port side 10 and also provided with the flat-boss-type L-rod (inductive susceptance) for impedance matching at the connection side thereof with the orthogonal-mode transducer 1.

Further, the transmission filter 8 may be spirally disposed around the center axis of the waveguide of the orthogonal-mode transducer.

As shown in FIGS. 2 and 3, the branching filter for the transmitter-receiver of this embodiment may be designed in a dimension of 70 mm×55 mm, and the transmission side may be also designed in a dimension of 60 mm×55 mm, so that the whole size of the branching filter for the transmitter-receiver is extremely small. Therefore, the lost wax process which is excellently and suitably used for compact casting products can be applied to produce the branching filter for the transmitter-receiver of this embodiment. If the lost wax process is applied, the branching filter can be integrally formed as one body having uniform thickness as a whole.

The branching filter for the transmitter-receiver (distributor) of this invention can be also integrally formed by a lost wax process (investment casting process). In this process, a dummy (model) is first formed of wax and placed in a vessel. Thereafter, casting material such as ethyl silicate [$Si(C_2H_5O)_4$] is filled into the vessel, congealed as a whole and heated to melt the wax and discharge the melt wax from the vessel, thereby forming a casting product. Through this process, the bosses 7, the cavities 6, the impedance transformer section 3, the cut off waveguide 12 and the L-rod 11 can be simultaneously and integrally manufactured as one body. Therefore, the casting product (branching filter for a transmitter-receiver) having no patch and no joint portion can be integrally manufactured as one body with high precision.

As described above, according to the present invention, the reception filter is connected through the impedance transformer section onto the waveguide axis of the orthogonal-mode transducer, so that the reception filter can be shortened. Further, the orthogonal connection between the transmission filter and the orthogonal-mode transducer enables the direct connection between the orthogonal-mode transducer and the cut off waveguide whose impedance is matched by the L-rod, so that no impedance transformer section having several step impedance transducer sections is required and the transmission filter can be shortened. Further, the transmission filter is spirally disposed around the center axis of the waveguide of the orthogonal-mode transducer, so that the whole branching filter for the transmitter-receiver can be miniaturized. In addition, the surrounding body of the waveguide is designed to be uniform, so that the branching filter for the transmitter-receiver can be integrally produced as one body by the lost wax process which is most suitable to mass-produce compact casting products. In the branching filter for the transmitter-receiver which is manufactured by the lost wax process, the waveguide of each of the orthogonal-mode transducer, the transmission filter and the reception filter has no dividing surface, so that the deterioration in XPD and impedance matching can be more intensively and synergistically suppressed.

What is claimed is:

1. A branching filter used for a transmitter-receiver comprising:

an orthogonal-mode transducer having a central axis, a transmission side and a reception side, an antenna connection port connected opposite said reception side, and a first impedance transducer coupled to the reception side;

a reception filter having opposed sides with a receiver port on one side, and being connected on the other side to said reception side of said first impedance transducer, said reception filter extending along said central axis of said orthogonal-mode transducer; and a transmission filter having a cut off waveguide for attenuating signals on a reception frequency band and which is orthogonally and directly connected to said orthogonal-mode transducer at one end of the cut off waveguide, and a transmitter port at the other end of the cut off waveguide, wherein said orthogonal-mode transducer, said reception filter and said transmission filter are an integral single body.

2. The branching filter as claimed in claim 1, wherein said orthogonal-mode transducer comprises a waveguide having a circular shape in cross-section, and said waveguide is provided at one end thereof with a circular coupling hole through which a reception wave is taken out, and also provided at a wall thereof with a rectangular coupling hole through which a transmission wave is fed out.

3. The branching filter as claimed in claim 1, wherein said reception filter comprises a band-eliminating filter in which rectangular cavities for eliminating transmission frequency band signals are provided on the H-plane of the rectangular waveguide thereof and circular bosses for pass-band matching are provided on a confronting surface of the rectangular cavities.

4. The branching filter as claimed in claim 1, wherein said transmission filter comprises a high pass filter having a reception frequency cut off waveguide of rectangular cross-section which serves to pass a transmission wave and is designed to be thin along the H-plane of the rectangular waveguide thereof, an impedance conversion waveguide for impedance matching at the transmitter port side, and an L-rod (inductive susceptance) for impedance matching at a connections side with said orthogonal-mode transducer.

5. The branching filter as claimed in claim 1, wherein said transmission filter is disposed in a spiral form around the center axis of the waveguide of said orthogonal-mode transducer.

6. The branching filter as claimed in claim 1, wherein said orthogonal-mode transducer comprises a waveguide having a rectangular shape in section, and said waveguide is provided at one end thereof with a rectangular coupling hole through which a reception wave is taken out, and also provided at a wall thereof with a rectangular coupling hole through which a transmission wave is fed out.

7. The branching filter as claimed in claim 1, wherein said reception filter comprises a band-eliminating filter in which rectangular cavities for eliminating transmission frequency band signals are provided on the H-plane of the rectangular waveguide thereof and rectangular bosses for pass-band matching are provided on a confronting surface of the rectangular cavities.

8. A branching filter used for a transmitter-receiver comprising:

a flange having an antenna port;

an orthogonal-mode transducer having a central axis and being coupled to said flange;

a reception filter having a receiver port at one end, said orthogonal-mode transducer being connected at an opposite end of said reception filter through a first impedance transducer section, said reception filter being aligned with said central axis of said orthogonal-mode transducer; and a transmission filter having a transmitter port, and said orthogonal mode transducer having a waveguide, said transmission filter being connected directly to said orthogonal-mode transducer and orthogonally to said central axis, said transmission filter having a cut off waveguide, for attenuating a reception frequency;

wherein said flange, said orthogonal-mode transducer, said transmission filter and said reception filter are an integral single body.

9. The branching filter as claimed in claim 8, wherein said reception filter comprises a band-eliminating filter.

10. The branching filter as claimed in claim 8, wherein said transmission filter comprises a high pass filter.

11. The branching filter as claimed in claim 8, wherein said high pass filter of said transmission filter is spirally formed.

12. The branching filter as claimed in claim 8, wherein said branching filter for the transmitter-receiver is integrally manufactured as a single body by a lost wax process.

13. The branching filter as claimed in claim 8, wherein said branching filter for the transmitter-receiver is integrally manufactured as one body by a lost wax process.

* * * * *